US010415606B2

(12) United States Patent
Kouno et al.

(10) Patent No.: US 10,415,606 B2
(45) Date of Patent: Sep. 17, 2019

(54) ACTUATOR

(71) Applicants: Koganei Corporation, Koganei-shi, Tokyo (JP); Tokyo Institute of Technology, Meguro-ku, Tokyo (JP)

(72) Inventors: Kazutoshi Kouno, Koganei (JP); Koichi Suzumori, Tokyo (JP)

(73) Assignees: Koganei Corporation, Koganei-shi, Tokyo (JP); Tokyo Institute of Technology, Meguro-ku, Tokyo (JP)

( * ) Notice: Subject to any disclaimer, the term of this patent is extended or adjusted under 35 U.S.C. 154(b) by 86 days.

(21) Appl. No.: 15/549,481

(22) PCT Filed: Oct. 28, 2015

(86) PCT No.: PCT/JP2015/080388
§ 371 (c)(1),
(2) Date: Aug. 8, 2017

(87) PCT Pub. No.: WO2016/132608
PCT Pub. Date: Aug. 25, 2016

(65) Prior Publication Data

US 2018/0031009 A1 Feb. 1, 2018

(30) Foreign Application Priority Data

Feb. 20, 2015 (JP) ..... 2015-031459

(51) Int. Cl.
*F15B 15/14* (2006.01)
*F15B 15/10* (2006.01)

(52) U.S. Cl.
CPC ..... *F15B 15/103* (2013.01); *F15B 15/1404* (2013.01); *F15B 2215/30* (2013.01)

(58) Field of Classification Search
CPC ..... B25J 9/142; F15B 15/103; F15B 15/1404
(Continued)

(56) References Cited

U.S. PATENT DOCUMENTS 5,067,390 A * 11/1991 Negishi ..... F15B 15/103 92/117 R
5,079,999 A 1/1992 Negishi et al.
(Continued)

FOREIGN PATENT DOCUMENTS

JP S60132103 A 7/1985
JP H0328507 A 2/1991
(Continued)

OTHER PUBLICATIONS

International Search Report for PCT Serial No. PCT/JP2015/080388 dated Jan. 6, 2016.

*Primary Examiner* — Michael Leslie
*Assistant Examiner* — Daniel S Collins
(74) *Attorney, Agent, or Firm* — McCormick, Paulding & Huber LLP

(57) ABSTRACT

An actuator main body (11) is formed by a plurality of artificial muscles (12). Each artificial muscle (12) includes an elastic tube (13) and a braided tube (15) covering an outside of the elastic tube (13). A first outside cylindrical body (21) is attached to one end portion of the actuator main body (11), and a second outside cylindrical body (22) is attached to the other end portion of the actuator main body (11). Bonding portions (23, 24) are respectively provided in the first and second outside cylindrical bodies (21, 22). The bonding portions (23, 24) are used to bond the elastic tube (13) to the braided tube (15), to bond the outside cylindrical body (21) to the artificial muscles (12), and to bond the outside cylindrical body (22) to the artificial muscles (12).

2 Claims, 6 Drawing Sheets

(58) Field of Classification Search
USPC ..... 92/48
See application file for complete search history.

(56) References Cited

U.S. PATENT DOCUMENTS

| | | | | |
|---|---|---|---|---|
| 6,868,773 | B2 * | 3/2005 | Davis | F15B 15/103<br>92/153 |
| 9,463,085 | B1 * | 10/2016 | Theobald | A61F 2/54 |
| 2001/0025541 | A1 * | 10/2001 | Bohlken | B25J 9/1075<br>74/490.01 |

FOREIGN PATENT DOCUMENTS

| | | | |
|---|---|---|---|
| JP | 2010-221329 | A | 10/2010 |
| JP | 2010-279689 | A | 12/2010 |

* cited by examiner (A)

(B)

(A)

(B)

ACTUATOR

CROSS-REFERENCE TO RELATED APPLICATIONS

This application is a National Stage application of International Patent Application No. PCT/JP2015/080388, filed on Oct. 28, 2015, which claims priority to Japanese Patent Application No. 2015-31459, filed on Feb. 20, 2015, each of which is hereby incorporated by reference in its entirety.

TECHNICAL FIELD

The present invention relates to an actuator having a plurality of artificial muscles that are bundled together, each artificial muscle having an elastic tube.

BACKGROUND ART

Japanese Unexamined Patent Application Publication No. S60-132103 discloses an actuator for use in robots having an elastic tube, or an enclosure made of hollow flexible rubber, and a tubular network covering an outside of the enclosure. This actuator is used for swinging, for example, a pin-connected arm member. Additionally, an actuator having a plurality of artificial muscles that are bundled together has been developed and assembled for nursing care devices, rehabilitation devices, and the like.

Japanese Unexamined Patent Application Publication No. H03-028507 discloses a bendable actuator having a plurality of tubular members. Each tubular member has a hollow elastic extensible member made of rubber or the like, and a braided structure that encloses the elastic extensible member. The braided structure is formed by polyester fibers, the elastic extensible member has a closure member fixed in each end portion, and the closure member is provided with a connecting aperture that communicates with the inside of the elastic extensible member. Japanese Unexamined Patent Application Publication No. 2010-279689 discloses an artificial muscle member comprising: an expansion body formed by a rubber tube surrounded by a braided lace, and a contraction body formed by another braided lace; an outer peripheral length of the braided lace of the contraction body is shorter than an outer peripheral length of the braided lace of the expansion body. The rubber tubes that are used for the expansion body are circular or star-shaped in their cross-sections, and strings made of polyester are used for each braided lace.

SUMMARY OF THE INVENTION

The actuator described in Japanese Unexamined Patent Application Publication No. S60-132103 has a single artificial muscle comprising an elastic tube and a tubular network that covers the outside of the elastic tube. For this reason, in order to swing the arm member to a predetermined swinging angle, a greater amount of expansion and contraction in a radial direction of the elastic tube is necessary; however, poor durability of the elastic tube limits the amount of expansion and contraction.

In contrast, if the actuator has a plurality of tubular members that are bundled together, as described in Japanese Unexamined Patent Application Publication No. H03-028507, the amount of extension in an axial direction of the actuator may be greatly increased, without the need to increase the amount of expansion and contraction of each tubular member. However, the actuator described in Japanese Unexamined Patent Application Publication No. H03-028507 has a sealing member inserted and fixed in each end portion of the tubular member, both end portions of the tubular members are bundled together by a fastening belt, and the fastening belt and the sealing member are further fastened to each other by a bolt. For this reason, tubular members having a small diameter may not be used, and miniaturization of the actuator may not be achieved.

An object of the present invention is to achieve the miniaturization of the actuator.

An actuator according to the present invention comprises: an actuator main body having a plurality of artificial muscles, each artificial muscle having an elastic tube and a braided tube covering an outside of the elastic tube; an outside cylindrical body attached to one end portion of the actuator main body; and a bonding portion provided in the outside cylindrical body, wherein the bonding portion bonds the elastic tube to the braided tube, and bonds the outside cylindrical body to the artificial muscles.

The actuator comprises an actuator main body having a plurality of artificial muscles, and an outside cylindrical body provided on one end portion of the actuator main body. Since the outside cylindrical body and the artificial muscles are bonded by a bonding portion formed in the outside cylindrical body, members that are used for supplying fluid can be omitted, and fluid can be directly supplied to the elastic tube. Thus, the actuator may be configured by using artificial muscles having a small diameter, thereby achieving miniaturization of the actuator.

DETAILED DESCRIPTION OF PREFERRED EMBODIMENTS

Figure 1:
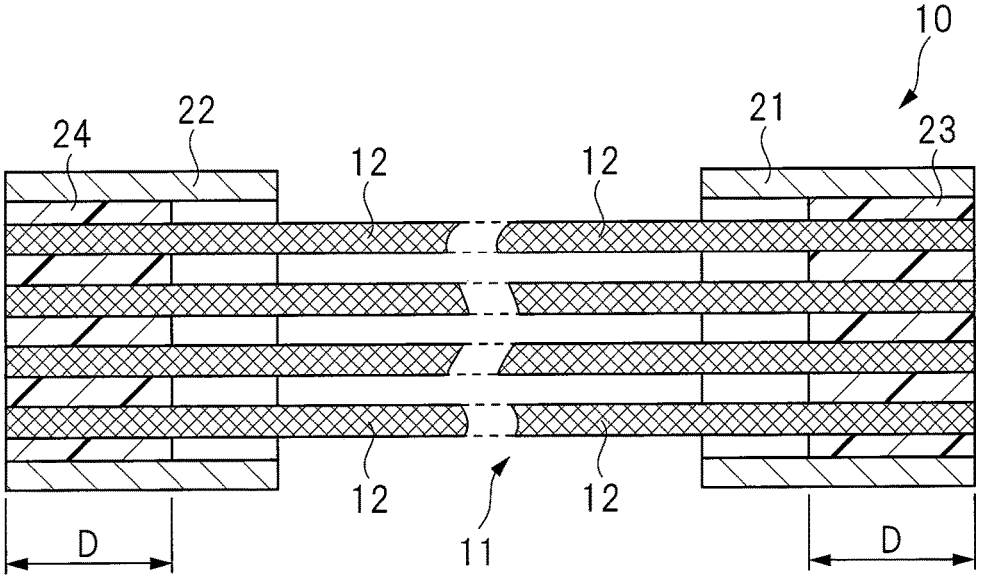
FIG. 1 is a partial cross-sectional view showing an actuator main body with outside cylindrical bodies attached to respective end portions thereof.
Figure 2:
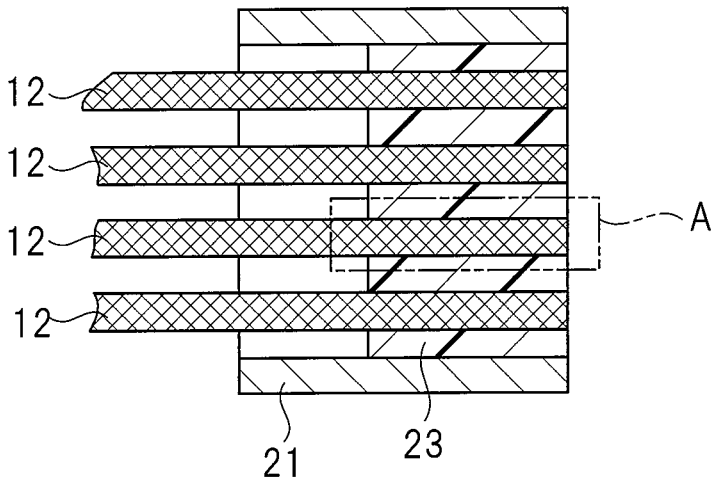
FIG. 2(A) is an enlarged cross-sectional view partially showing the actuator main body.
FIG. 2(B) is a lateral cross-sectional view of FIG. 2(A)
Figure 2:
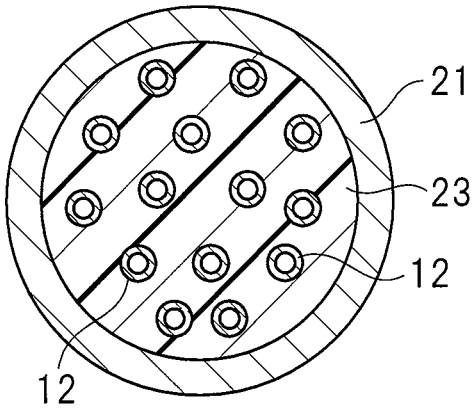
Figure 3:
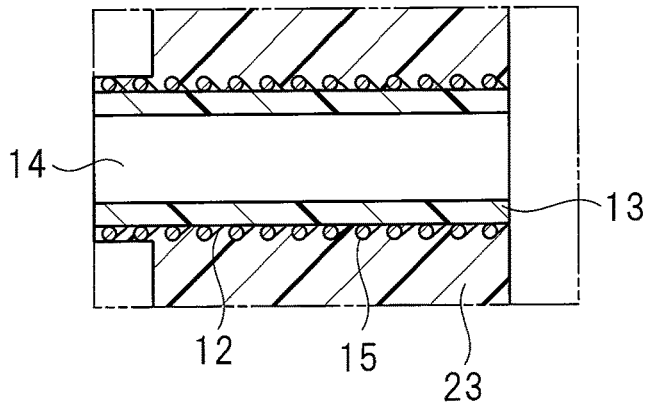
FIG. 3 is an enlarged cross-sectional view of section "A" of FIG. 2(A)
Figure 4:
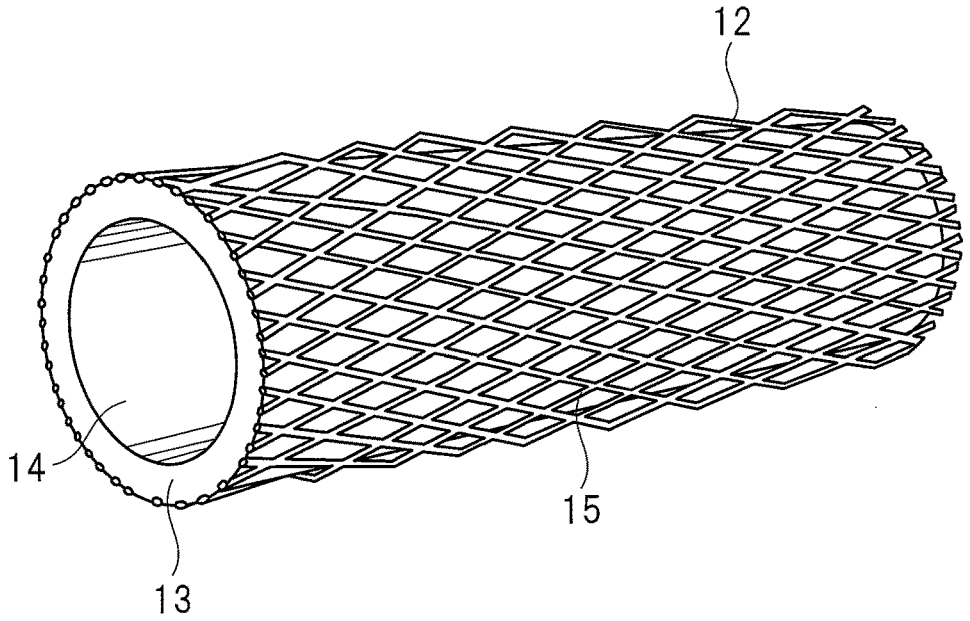
FIG. 4 is a perspective view showing a section of an artificial muscle.

Hereinafter, an embodiment of the present invention will be described in detail on the basis of the drawings. As shown in FIG. 1, an actuator 10 of the present invention has an actuator main body 11. As shown in FIGS. 2 to 4, the actuator main body 11 has artificial muscles 12 that are positioned in parallel with each other and are bundled together.

As shown in FIG. 4, each artificial muscle 12 comprises an elastic tube 13 which is circular in its cross-section, and has a through hole 14 through which fluid such as compressed air is supplied. The elastic tube 13 is extensible and retractable in an axial direction thereof, as well as being expandable and contractible in a radial direction thereof. The elastic tube 13 is made of silicone resin mainly composed of high molecular silicone. However, the elastic tube 13 may be made of other elastically deformable materials such as synthetic resin and synthetic rubber. An outside of the elastic tube 13 is covered by a braided tube 15. The braided tube 15 is a braided structural member formed by knitting Tetoron strings into a tubular shape, and covers the outside of the elastic tube 13 so as to reinforce the elastic tube 13. The material for the braided tube 15 is not limited to Tetoron, and various materials such as polyester fibers may be used. As shown in FIG. 4, the elastic tube 13 is partially exposed to the outside through gaps formed among the strings configuring the braided tube 15. FIG. 4 shows a single layer of the braided tube 15 covering the outside of the elastic tube 13; however, multiple layers of braided tubes may be used to cover the elastic tube 13.

As shown in FIG. 1, the actuator main body 11 has two end portions; a first outside cylindrical body 21 is attached to one end portion of the actuator main body 11, and a second outside cylindrical body 22 is attached to the other end portion of the actuator main body 11. The outside cylindrical bodies 21 and 22 are made of metal or resin. A bonding portion 23 is provided in the first outside cylindrical body 21, and a bonding portion 24 is provided in the second outside cylindrical body 22. The bonding portions 23 and 24 are made of thermosetting resin, and are used to bond the elastic tube 13 to the braided tube 15, to bond the artificial muscles 12 to each other, and to bond the outside cylindrical bodies 21 and 22 to the artificial muscles 12. As shown in FIG. 3, before being thermally cured, fluidic thermosetting resin that forms the bonding portion 23 is injected into a gap between the first outside cylindrical body 21 and the artificial muscles 12; resin flows into gaps among the strings which configure the braided tube 15 and is thermally cured, thereby bonding the elastic tube 13 to the braided tube 15. In the same manner, resin that forms the bonding portion 24 flows into gaps among the strings which configure the braided tube 15, and bonds the elastic tube 13 to the braided tube 15.

Any number of artificial muscles 12 may be selected to configure the actuator main body 11. As shown in FIG. 2(B), the artificial muscles 12 may be positioned apart from each other and be bundled together, or the artificial muscles 12 may have an outer peripheral surface made in contact with outer peripheral surfaces of other artificial muscles 12 and be bundled together. Even if the artificial muscles 12 are bundled together with the outer peripheral surfaces made in contact with other outer peripheral surfaces, when fluidic thermosetting resin that forms the bonding portions 23 and 24 is respectively injected into the outside cylindrical bodies 21 and 22, the thermosetting resin flows into the gaps in the braided tube 15 of each artificial muscle 12. When thermosetting resin injected into the outside cylindrical bodies 21 and 22 is thermally cured, the bonding portions 23 and 24 are formed so that adjacent artificial muscles 12 are bonded to each other. A depth of the bonding portion 23 or 24 from its surface to an end face of the actuator 10, or a length "D" in an axial direction of the bonding portion, is smaller than a length of the outside cylindrical body 21 or 22 in an axial direction of the outside cylindrical body. However, the bonding portions 23 and 24 may have the same axial lengths as the outside cylindrical bodies 21 and 22.

As mentioned above, thermosetting resin is injected into an outside of both end portions of the artificial muscles 12, and by this thermosetting resin, the artificial muscles 12 are fixed to the outside cylindrical bodies 21 and 22. Therefore, since the through hole 14 is opened on the end face of the actuator 10, no sealing members with connection holes formed therein need to be inserted into the elastic tube 13. Since no sealing members need to be inserted into the elastic tube 13, the actuator main body 11 may be manufactured by using the artificial muscles 12 having a small diameter; thus, miniaturization of the actuator 10 can be achieved.

Figure 5:
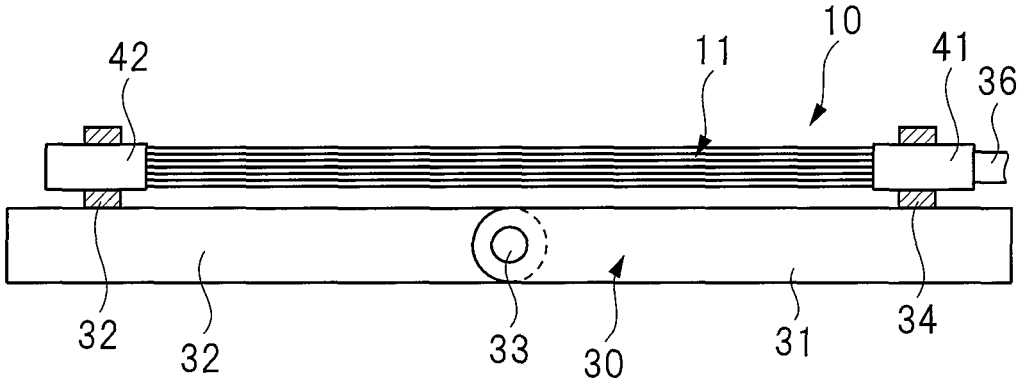
FIG. 5(A) is a front view showing the actuator attached to a swinging member and which is in an extended state.
FIG. 5(B) is a front view showing the actuator attached to a swinging member and which is in a contracted state.
Figure 5:
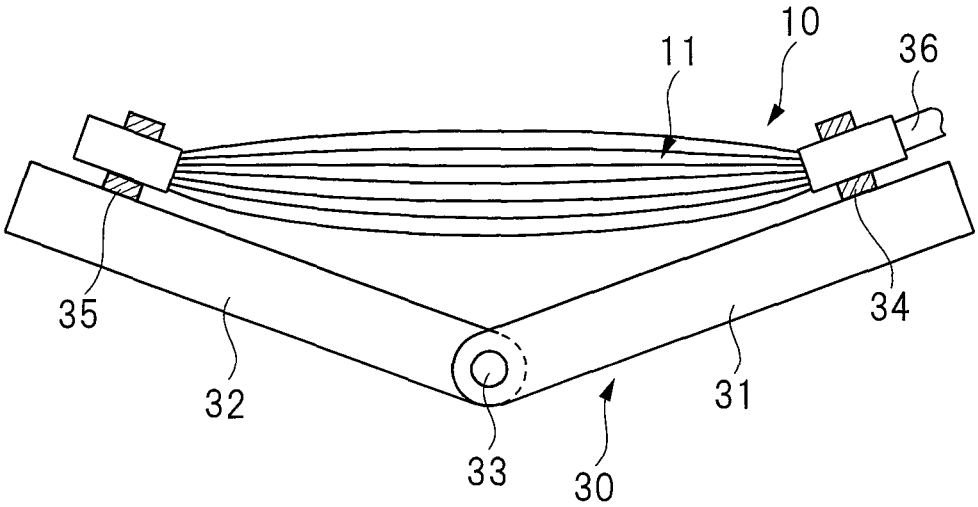

FIG. 5(A) is a front view showing the actuator 10 attached to a swinging arm and which is in an extended state; FIG. 5(B) is a front view showing the actuator 10 in a contracted state.

The swinging arm 30 has a first swinging member 31 and a second swinging member 32. Both swinging members 31 and 32 are swingably connected to each other by a pin 33. A first bracket 34 is attached to the first swinging member 31, and a second bracket 35 is attached to the second swinging member 32. A first joint member 41 is attached to one end portion of the actuator main body 11, and a second joint member 42 is attached to the other end portion of the actuator main body 11. The first joint member 41 is attached to the first bracket 34, and the second joint member 42 is attached to the second bracket 35. In this manner, one end portion of the actuator main body 11 is attached to the first swinging member 31, and the other end portion of the actuator main body 11 is attached to the second swinging member 32.

A supply pipe 36 is attached to the first joint member 41 and supplies fluid such as compressed air; compressed air supplied from the supply pipe 36 is further supplied to all through holes 14 in the artificial muscles 12 which configure the actuator main body 11. In contrast, the second joint member 42 blocks communication between the through holes 14 of the artificial muscles 12 and the outside by a blocking member. Therefore, as shown in FIG. 5(A), when no fluid is supplied to the artificial muscles 12, the swinging members 31 and 32 are in a straightened state prior to being swung. When compressed air is supplied to the through holes 14 from the outside through the supply pipe 36, each artificial muscle 12 expands in a radial direction thereof, while contracting in a longitudinal direction thereof. Thus, as shown in FIG. 5(B), the swinging arm 30 is bent about the pin 33. In this manner, when the actuator 10 is applied for driving the swinging arm 30, the swinging arm 30 can be driven by supplying fluid to and discharging fluid from the artificial muscles 12.

Figure 6:
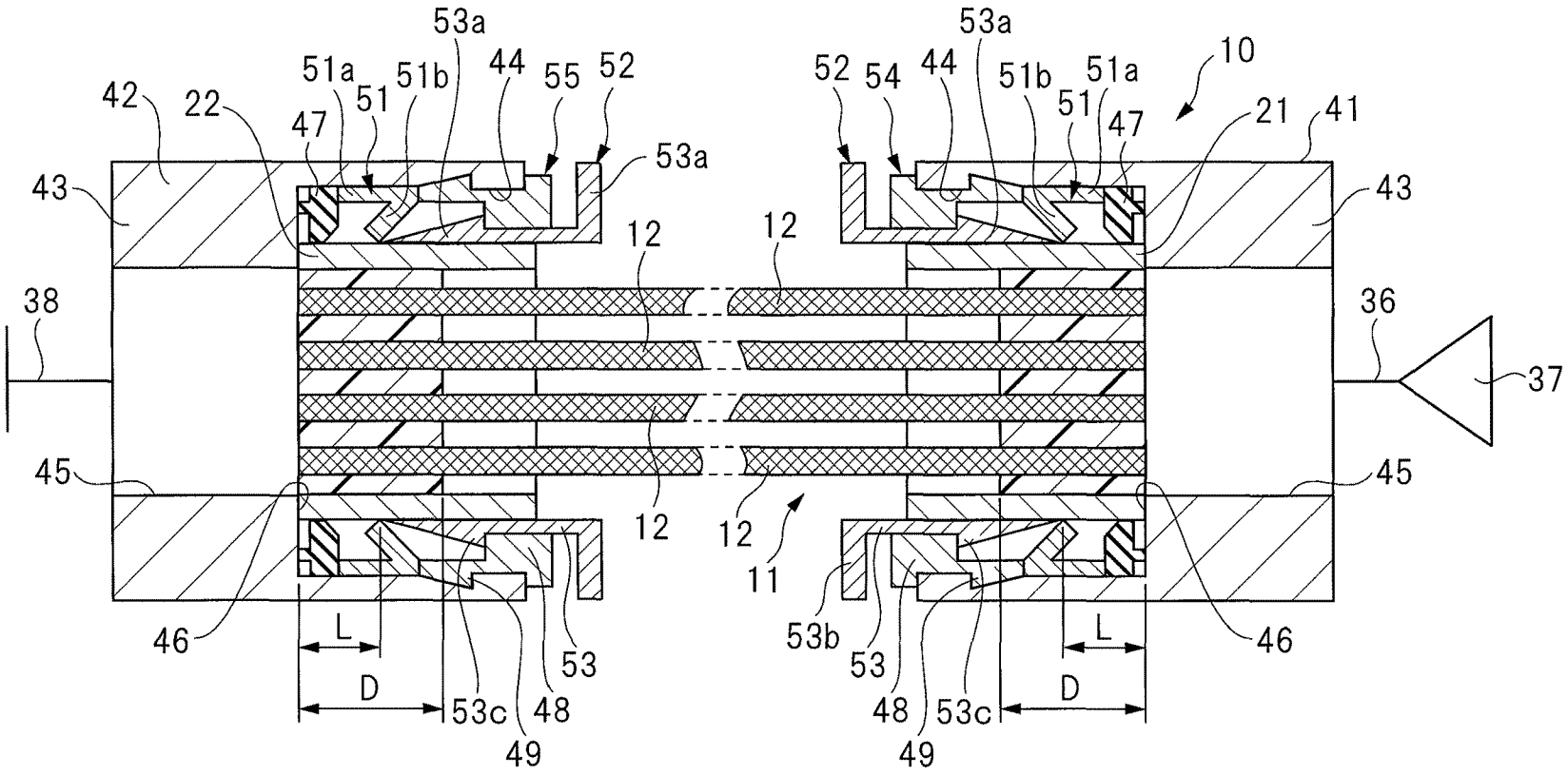
FIG. 6 is a partial cross-sectional view showing the actuator with joint members attached to respective end portions thereof.

FIG. 6 is a partial cross-sectional view showing the actuator with joint members attached to respective end portions thereof. As shown in FIG. 6, the first joint member 41 has the same structure as the second joint member 42, and each joint member has a cylindrical joint main body 43. The joint main body 43 is made of metal or rigid resin. Each joint main body 43 is provided with a large-diameter hole 44 and a small-diameter hole 45; an abutting surface 46 is provided between the large-diameter hole 44 and the small-diameter hole 45, and extends in a radial direction of the joint main body. One end portion of the actuator main body 11 is inserted into the first joint member 41, and an end face of the first outside cylindrical body 21 abuts on the abutting surface 46. The other end portion of the actuator main body 11 is inserted into the second joint member 42, and an end face of the second outside cylindrical body 22 abuts on the abutting surface 46.

A sealing member 47 is provided in each joint main body 43 and is positioned on the same side as the abutting surface 46 in the large-diameter hole 44; each sealing member 47 respectively seals gaps between the large-diameter hole 44 and the outside cylindrical bodies 21 and 22. A guide ring 48 is provided in an opening end portion of the large-diameter hole 44, and is provided with an engaging claw 49 that is engaged with the joint main body 43. A locking member 51 is attached between the guide ring 48 and the sealing member 47.

The locking member 51 is made of elastic metal such as stainless steel, and has: a cylindrical portion 51*a* fitted in the large-diameter hole 44; and a locking claw 51*b* bent at an end portion of the cylindrical portion 51*a* on the guide ring 48 side, and extends radially inward toward the sealing member 47. Therefore, when an end portion of the actuator main body 11 is inserted into the joint main body 43, the outside cylindrical body 21 or 22 pushes a tip end of the locking claw 51*b*, whereby the locking claw 51*b* is elastically deformed and expands radially outward, allowing the actuator main body 11 to be inserted. In contrast, when the actuator main body 11 is pulled away from the joint main body 43, the locking claw 51*b* is pressed onto the outside cylindrical body 21 or 22, and a self-tightening effect on the locking claw 51*b* prevents the actuator main body 11 from falling out of the joint main body 43.

A release ring 52 is attached to the guide ring 48, and is movable in an axial direction of the guide ring. The release ring 52 is made of metal or rigid resin, and has a cylindrical portion 53 slidably fitted in the guide ring 48. One end portion of the cylindrical portion 53 is provided with a claw activating portion 53*a* that abuts on the locking claw 51*b*; the other end portion of the cylindrical portion 53 is provided with an operational portion 53*b* that protrudes radially outward. The release ring 52 is provided with an engaging claw 53*c* that is engaged with the guide ring 48, and this engagement between the engaging claw 53*c* and the guide ring 48 prevents the release ring 52 from falling out of the joint main body 43. When the release ring 52 is pushed toward the locking member 51 beyond the position shown in FIG. 6, the locking claw 51*b* is elastically deformed radially outward and is moved away from the first outside cylindrical body 21. At this time, the actuator main body 11 can be detached from the joint main body 43 by pulling out the actuator main body 11 from the joint main body 43. In this manner, the first joint member 41 is designed as a quick-joint mechanism 54, and the second joint member 42 is designed as a quick-joint mechanism 55. Thus, by inserting the end portion of the actuator main body 11 into the joint main body 43, the actuator main body 11 can be fastened to the joint main body 43. Additionally, by pushing the release ring 52, the actuator main body 11 can be detached from the joint main body 43.

As shown in FIG. 6, "L" indicates a length in an axial direction of the actuator main body from the abutting surface 46 to the locking claw 51*b*, or a length from an end face of the actuator main body 11 to a biting point in which the locking member 51*b* bites into the outside cylindrical body 21 or 22 of the actuator main body 11. Additionally, "D" indicates the length of the bonding portion 23 or 24 in the axial direction of the bonding portion, or the length from the surface of the bonding portion 23 or 24 to the end face of the actuator main body 11. The length "D" in the axial direction of the bonding portion is set to be greater than the length "L" in the axial direction of the actuator main body (D>L). By setting the depth of the bonding portion 23 or 24, or the length "D" in the axial direction of the bonding portion, to be greater than the length "L" relative to the biting point of the locking member 51, a tightening force of the locking member 51 is applied to the bonding portion 23 or 24. Thus, the end portion of the actuator main body 11 can be infallibly fastened to the joint main body 43 without being deformed, even if the outside cylindrical bodies 21 and 22 are made to be thinner. As a result, the number of artificial muscles 12 in the actuator main body 11 can be increased without the need to change the size of the outside cylindrical bodies 21 and 22.

Hereinafter, the depth of the bonding portion 23 or 24, or the length "D" in the axial direction of the bonding portion, will be supplementarily described. Each bonding portion 23 or 24 in the outside cylindrical body 21 or 22 has a surface which faces the end face of the opposing actuator main body 11; the surfaces of the bonding portions 23 and 24 tend to fail to be completely perpendicular relative to the axial direction of the bonding portion when finished. In such a case, the shortest length from the end face of the actuator main body 11 to the surface failing to be completely perpendicular relative to the axial direction of the actuator main body is set as the depth of the bonding portion, or length "D" in the axial direction of the bonding portion. In other words, an adhesive will only need to be filled in the radial direction relative to the biting point of the locking member 51.

The first joint member 41 that is attached to one end portion of the actuator main body 11 is connected to the supply pipe 36 which communicates with the small-diameter hole 45. Fluid supplied from a fluid supply source 37 through the supply pipe 36 is further supplied to each through hole 14 in the elastic tubes 13. On the other hand, the second joint member 42 that is attached to the other end portion of the actuator main body 11 is provided with a closing member 38 which prevents fluid from flowing out of the elastic tube 13. Although the small-diameter hole 45 may be omitted from the second joint member 42, the number of parts of the actuator 10 can be reduced by using the second joint member 42 that has the same structure as the first joint member 41,.

Figure 7:
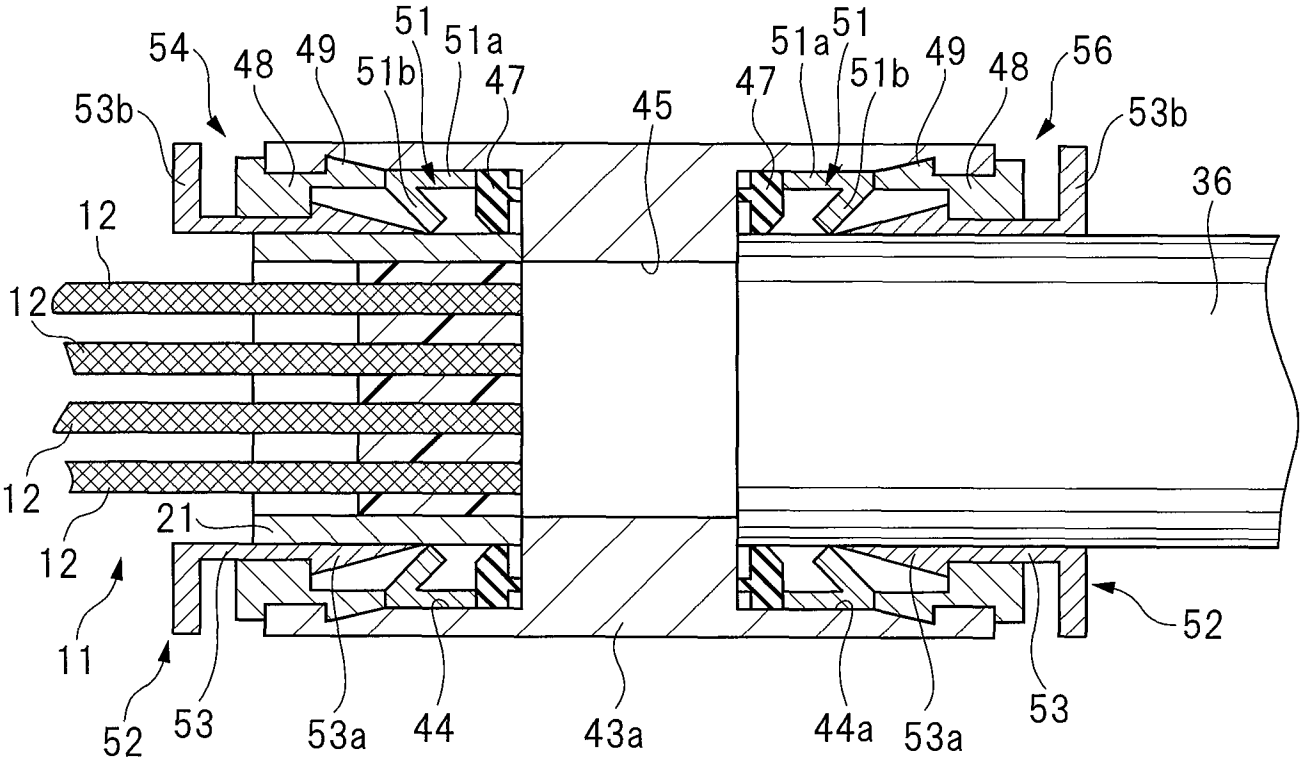
FIG. 7 is a cross-sectional view showing a variation of a first joint member attached to one end portion of the actuator.

FIG. 7 is a cross-sectional view showing a variation of the first joint member 41 attached to one end portion of the actuator. The first joint member 41 has a joint main body 43*a*, and the joint main body 43*a* has a center portion extending in a radial direction thereof that is provided with a small-diameter hole 45. One end portion of the joint main body 43*a* is provided with a large-diameter hole 44, and a quick-joint mechanism 54, which has the same structure as that of the joint main body 43 shown in FIG. 6, is provided in the large-diameter hole 44. The other end portion of the joint main body 43*a* is provided with a large-diameter hole 44*a*, and a quick-joint mechanism 56 is provided in the large-diameter hole 44*a*. The quick-joint mechanism 56 has the same structure as the quick-joint mechanism 54; members identical to those configuring the quick-joint mechanism 54 are indicated by the same reference numerals, and descriptions of the quick-joint mechanism 56 redundant to those of the quick-joint mechanism 54 are omitted as appropriate. The joint main body 43*a* is provided with a supply pipe 36 that is detachably attached by the quick-joint mechanism 56.

The present invention is not to be limited to the above-mentioned embodiments, and is able to be variously modified as long as they do not depart from the scope of the invention, which is defined by the appended claims. For example, the shape of the cross-section of the elastic tube 13 is not limited to be circular, and may instead be quadrilateral, polygonal, star-shaped, or the like. Additionally, the second outside cylindrical body 22 may be omitted, and the end face of the elastic tube 13 facing the second outside cylindrical body 22 may be sealed by resin.

The actuator of the present invention is applied to drive two swinging members connected to each other by a pin.

Although various embodiments of the present invention have been described and shown, the invention is not restricted thereto, but may also be embodied in other ways within the scope of the subject-matter defined in the following claims.

What is claimed is:

1. An actuator comprising:

an actuator main body having a plurality of artificial muscles, each artificial muscle having an elastic tube and a braided tube covering an outside of the elastic tube;

an outside cylindrical body attached to one end portion of the actuator main body;

a bonding portion provided in the outside cylindrical body, wherein the bonding portion bonds the elastic tube to the braided tube, and bonds the outside cylindrical body to the artificial muscles; and a joint member to which the outside cylindrical body is inserted, wherein a locking member is provided on the joint member and fastens the outside cylindrical body and the joint member to each other, and a length in an axial direction from an end face of the actuator main body to a surface of the bonding portion is greater than a length in an axial direction from the end face of the actuator main body to a biting point in which the locking member bites into the outside cylindrical body.

2. An actuator comprising:

an actuator main body having a plurality of artificial muscles, each artificial muscle having an elastic tube and a braided tube covering an outside of the elastic tube;

a first outside cylindrical body attached to one end portion of the actuator main body;

a second outside cylindrical body attached to the other end portion of the actuator main body;

a bonding portion provided in the first outside cylindrical body and the second outside cylindrical body, wherein the bonding portion bonds the elastic tube to the braided tube, and bonds the first and second outside cylindrical bodies to the artificial muscles;

a first joint member to which the first outside cylindrical body is inserted; and a second joint member to which the second outside cylindrical body is inserted, wherein a locking member for fastening the first outside cylindrical body and the first joint member to each other is provided on the first joint member, and a locking member for fastening the second outside cylindrical body and the second joint member to each other is provided on the second joint member, and a length in an axial direction from an end face of the actuator main body to a surface of the bonding portion is greater than a length in the axial direction from one of the end faces of the actuator main body to a biting point in which one of the locking members bite into the outside cylindrical body.

* * * * *